US005819668A

United States Patent [19]

Meindl

[11] Patent Number: 5,819,668

[45] Date of Patent: Oct. 13, 1998

[54] SYSTEM FOR THE TRANSPORTATION OF PERSONS AND/OR GOODS

[75] Inventor: Bernd Meindl, Hard, Austria

[73] Assignee: Konrad Doppelmayer & Sohn Maschinenfabrik Gesellschaft mbH & Co KG, Wolfurt, Austria

[21] Appl. No.: 824,444

[22] Filed: Mar. 26, 1997

[30] Foreign Application Priority Data

Mar. 26, 1996 [AT] Austria ..... 552/96

[51] Int. Cl.[6] ..... B61B 9/00

[52] U.S. Cl. ..... 104/168; 104/173.1; 104/197

[58] Field of Search ..... 104/28, 163, 168, 104/173.1, 197, 209

[56] References Cited

U.S. PATENT DOCUMENTS

| | | | |
|---|---|---|---|
| 433,667 | 8/1890 | Wendnagel | 104/197 |
| 3,412,690 | 11/1968 | Broggie et al. | 104/168 |
| 3,530,800 | 9/1970 | Watkins | 104/168 |
| 3,797,407 | 3/1974 | Laurent | 104/173.1 |
| 4,564,100 | 1/1986 | Moon | 104/168 |
| 4,627,361 | 12/1986 | Tarassoff | 104/28 |
| 5,595,122 | 1/1997 | Levi et al. | 104/173.1 |

FOREIGN PATENT DOCUMENTS

| | | | |
|---|---|---|---|
| 0673817B1 | 9/1995 | European Pat. Off. . | |
| 16463 | 1/1989 | Japan | 104/173.1 |

*Primary Examiner*—S. Joseph Morano

*Attorney, Agent, or Firm*—Herbert L. Lerner; Laurence A. Greenberg

[57] ABSTRACT

Persons and/or goods are transported in a plurality of vehicles with running wheels rolling on a track, such as on rails. A continuously moving, endless traction cable drives the vehicles on the track, and a clamping assembly selectively disconnects the vehicles from and connects the vehicles to the traction cable. The vehicles are disconnected from the traction cable in boarding stations, where deceleration wheels and acceleration wheels come into contact with a contact surface on the underside of the vehicles. The deceleration wheels and acceleration wheels rotate about substantially horizontal axes and they decelerate and accelerate the vehicles, respectively, upon being brought into contact with the contact surface. The deceleration and acceleration wheels are rotatably supported on a free end of swivel arms which are pivotally supported about an axis which extends substantially horizontally and substantially parallel to the track. An adjustment spring bears on each of the swivel arms for forcing the deceleration and acceleration wheels against the contact surface on the underside of the vehicle.

7 Claims, 4 Drawing Sheets

SYSTEM FOR THE TRANSPORTATION OF PERSONS AND/OR GOODS

BACKGROUND OF THE INVENTION

1. Field of the Invention

The instant application pertains to transportation systems for transporting persons and/or goods. The system has a plurality of vehicles equipped with running wheels; the vehicles are connectable to a continuously moving traction cable with which they are driven along a track, specifically along rails; deceleration and/or acceleration wheels are provided at boarding/alighting stations where the vehicles are disconnected from the traction cable. The deceleration and/or acceleration wheels, which rotate about substantially horizontal axes, can be brought into contact with the vehicles, whereby their driving speed is reduced or increased. The vehicles are embodied on their underside with at least one contact surface which cooperates with the deceleration and/or acceleration wheels.

2. Description of the Related Art

A system of this general type has become known, heretofore, from the European publication EU-A1 673 817. In that prior art system, the vehicles are embodied with pneumatic tires by means of which they can be driven along the track. On account of the pneumatic tires, the vehicles can assume different height levels, depending on the number of passengers they are carrying. In order to ensure the required deceleration of the vehicles after they have been disconnected from the traction cable, or the required acceleration of the vehicles before they are connected to the traction cable, it must be ensured that the deceleration wheels and/or the acceleration wheels lie closely alongside the contact surfaces on the underside of the vehicles. However, because the vehicles are at different height levels, the deceleration and/or acceleration wheels do not lie closely alongside the contact surfaces in the case of a small number of passengers and the corresponding higher level of the vehicles. If, however, the deceleration and/or acceleration wheels are disposed such that they lie closely alongside the contact surfaces when the vehicles are at a higher level, this results in a strong pressure occurring between the wheels and the contact surface in the case of a large number of passengers and a corresponding lower level of the vehicles, which pressure subjects the bearings of the deceleration and/or acceleration wheels and the surfaces of these wheels (produced from an elastic material, e.g. rubber), to such an extent of wear and tear that the service life of those components is reduced to a considerable degree.

Furthermore, such systems require that the traction cable be securely grasped by the coupling clamps which are disposed on the underside of the vehicle at the end of the acceleration segment, in order to ensure the connection of the vehicles to the traction cable. Moreover, it must be ensured that the traction cable does not fall out of the coupling clamps through its own weight when the coupling clamps are being opened at the beginning of the deceleration segment, as this could result in increased wear of the coupling clamps.

SUMMARY OF THE INVENTION

It is accordingly an object of the invention to provide a system for the transportation of persons and/or goods, which overcomes the above-mentioned disadvantages of the heretofore-known devices and methods of this general type.

With the foregoing and other objects in view there is provided, in accordance with the invention, a transportation system, comprising:

a plurality of vehicles equipped with running wheels and a contact surface disposed on an underside thereof, a continuously moving, endless traction cable by which the vehicles are driven along a track (e.g. rails), and a clamping assembly for selectively disconnecting the vehicles from and connecting the vehicles to the traction cable;

a boarding station in which the vehicle is disconnectable from the traction cable, and a plurality of deceleration wheels and acceleration wheels disposed along the track in the boarding station, the deceleration wheels and acceleration wheels rotating about substantially horizontal axes and decelerating and accelerating the vehicle, respectively, upon being brought into contact with the contact surface on the underside of the vehicle; and swivel arms each having a free end on which the deceleration wheels and the acceleration wheels, respectively, are rotatably supported, the swivel arms being pivotally supported about an axis which extends substantially horizontally and substantially parallel to the track, and an adjustment spring bearing on each of the swivel arms for pressing the deceleration wheels and the acceleration wheels against the contact surface on the underside of the vehicle.

In other words, the objects of the invention are attained in that the deceleration and/or acceleration wheels are borne on the free end of a swivel arm, which is swivelable about an approximately horizontal axle which is aligned substantially parallel to the track. Each of the swivel arms is subject to the effect of an adjustment spring, through which the deceleration and/or acceleration wheels can be pressed against the contact surface on the vehicle.

The height level of the deceleration and/or acceleration wheels can be adapted to the level of the contact surface by means of the pivotable swivel arm, which considerably reduces the load and thereby the wear and tear on the deceleration wheels and/or on the acceleration wheels.

In accordance with a further advantageous feature of the invention, the swivel arms for the deceleration and/or acceleration wheels are each borne in a U-shaped console, with the adjustment spring being disposed between the legs thereof, and the upper section connecting the two legs forming a stop against the swinging of the swivel arms. A drive wheel can also be borne on the swivel arms, whereby the drive wheel is coupled in traction with the deceleration and/or acceleration wheel.

In accordance with another preferred embodiment, the support rollers for the traction cable are borne in the areas where the vehicles are connected to and/or disconnected from the traction cable on a swivel arm, which is pivotable about a substantially horizontal axis and transverse to the track. These swivel arms are also subject to the effect of an adjustment spring, which causes them to swing upwardly. Stops can also be disposed on the supporting frame, on which the swivel arms can be brought to rest through the adjustment springs associated therewith.

Other features which are considered as characteristic for the invention are set forth in the appended claims.

Although the invention is illustrated and described herein as embodied in a system for the transportation of persons and/or of goods, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

Figure 1:
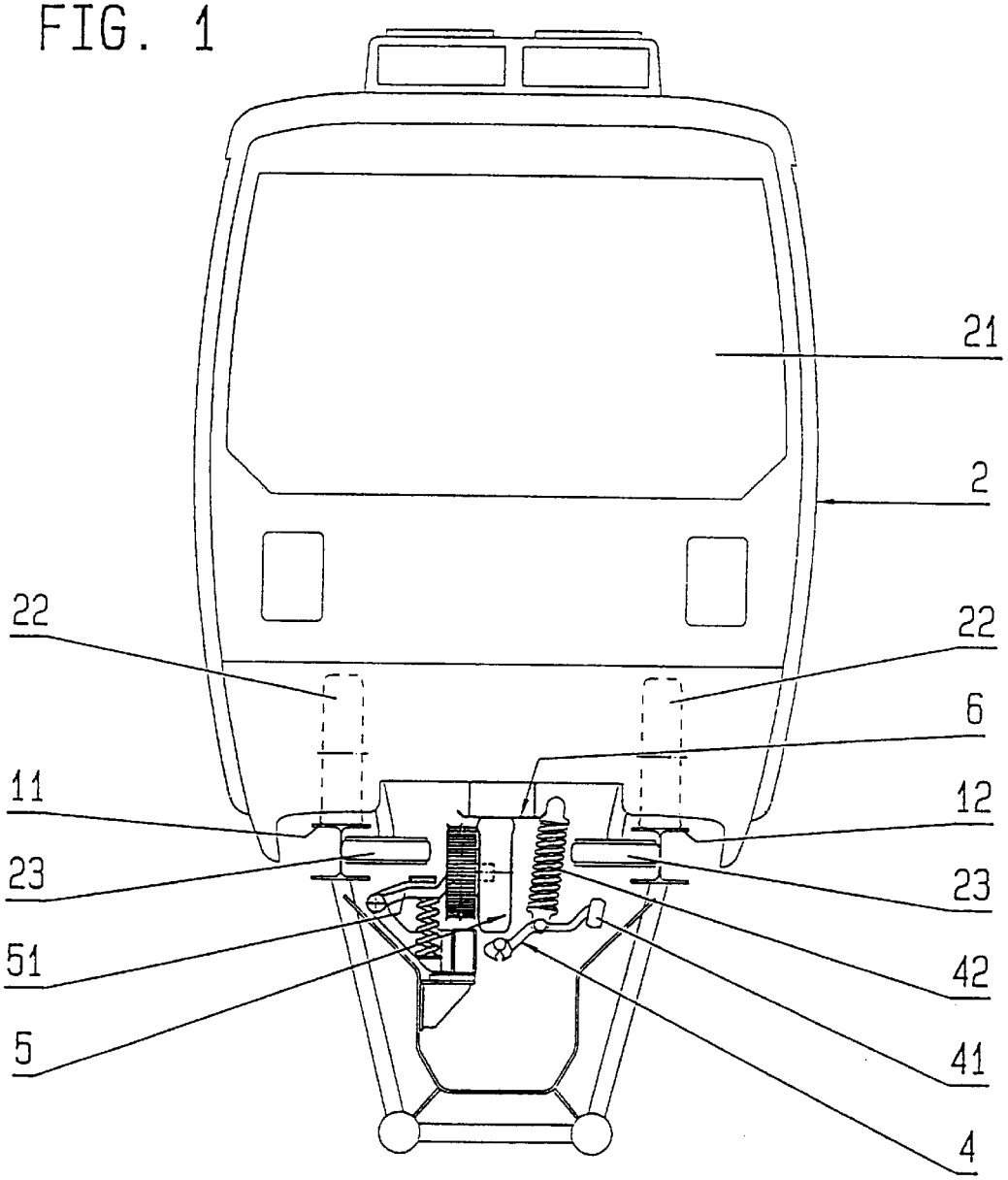
FIG. 1 is a vertical cross-sectional view taken through a system according to the invention in the area of the deceleration wheels and/or acceleration wheels.

Referring now to the figures of the drawing in detail and first, particularly, to FIG. 1 thereof, there is seen a system in accordance with the invention which comprises a track with two rails 11 and 12, along which a vehicle 2 can be driven. An endless traction cable (reference numeral 3 in FIGS. 3, 4), which is continuously driven, drives the vehicle 2. The traction cable runs between two rails 11 and 12 and the vehicle 2 can be selectively coupled to and uncoupled from the traction cable by means of a clamping assembly 4.

As the vehicle 2 enters or leaves the boarding/alighting stations (simply referred to as boarding stations), it runs onto deceleration and acceleration wheels 5, respectively. The deceleration and acceleration wheels 5 rotate about horizontal axes between the rails 11 and 12. The deceleration and/or acceleration wheels come to rest on a contact surface 6 disposed on the underside of vehicle 2, whereby the vehicle 2 can be selectively decelerated after being disconnected from the traction cable and accelerated just prior to clamping to the traction cable.

The vehicle 2 has a cabin 21 for the transportation of persons and/or goods. Furthermore, it is provided with running wheels 22, by means of which it runs along the rails 11 and 12. The vehicle 2 is further equipped with guide rollers 23, which come to rest on the inner surfaces of the vertical segments of the I-shaped rails 11 and 12. Moreover, a clamping assembly 4 is disposed on its underside, by means of which vehicle 2 can is selectively connected to the traction cable. The clamping assembly 4 is controlled by a cam roller 41 which runs on cam rails or control rails, such that the vehicle 2 is decoupled from the traction cable 3. In other words, the coupling clamps are opened by the caming action in opposition to the effect of a clamping adjustment spring 42.

The base of the vehicle 2 is provided with a contact surface 6, on which the deceleration and acceleration wheels 5—which are rotatable about axles that are at least approximately horizontal—come to rest in the boarding/alighting stations. The contact surface 6 is rigidly attached to the underside of vehicle 2.

The deceleration and/or acceleration wheels 5 are driven by motors, which each drive a group of wheels 5. The groups of wheels 5 are connected to each other through gears, such as for instance V-belt drives, which ensure that the wheels 5 attain the various peripheral speeds required for decelerating and accelerating vehicle 2. Alternatively, the wheels can be driven by means of individually associated motors that are controlled through a centralized control device. Furthermore, there are provided speedometers, the outputs of which are connected to the respective drive motor controls.

Figure 2:
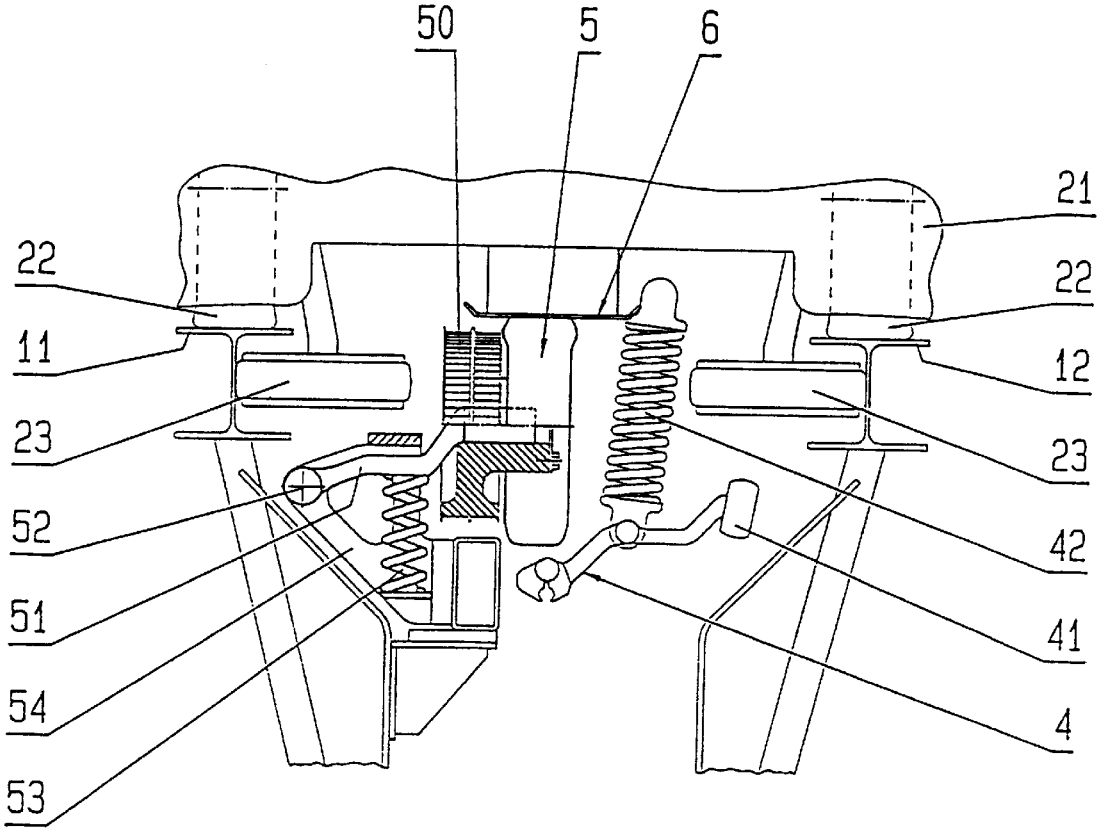
FIG. 2 is a partly broken-away detail of FIG. 1, on a slightly enlarged scale.

With particular reference to FIG. 2, drive wheels 50 are coupled by traction to the deceleration and/or acceleration wheels 5. The wheels 50 and 5 are each borne at the end of a swivel arm 51, which is pivotable about an axis 52 which extends in parallel to the track and which is subject to the effect of an adjustment spring 53. The adjustment spring 53 is located between the two legs of a U-shaped support 54, wherein the upper section connecting the two legs functions as an upper stop, against which swivel arm 51 can come to rest under the effect of the spring 53. The wheels 5 are thereby swung to a higher level, whereby—irrespective of the height of the contact surface 6 brought about by the load in the vehicle (e.g. the number of passengers)—they always come to rest on this with the degree of pressure required for their effect. In this way, the operating requirements are met without giving rise to excessive wear and tear.

Figure 3:
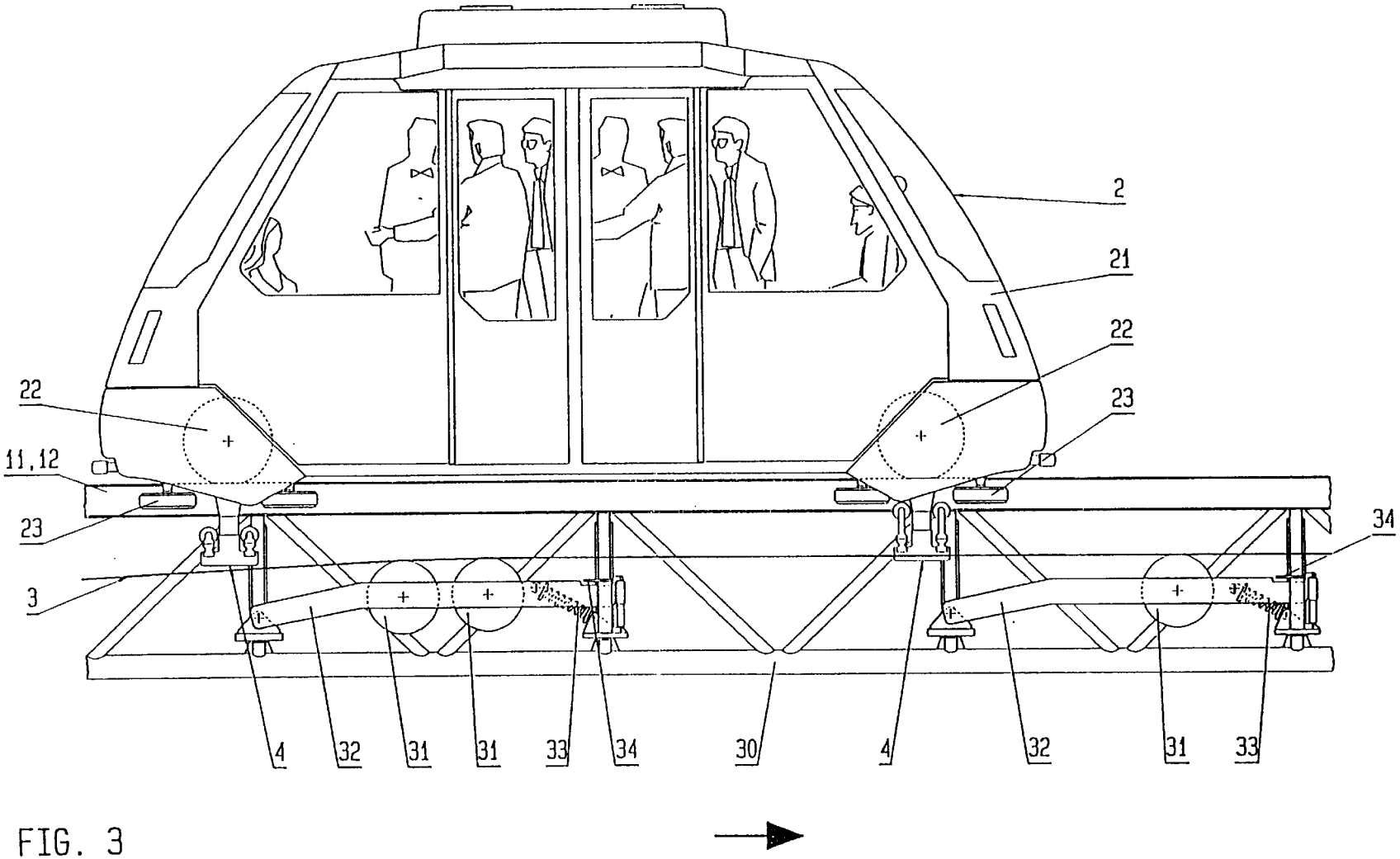
FIG. 3 is a partial side-elevational view of the transportation system in one of the coupling areas.
Figure 4:
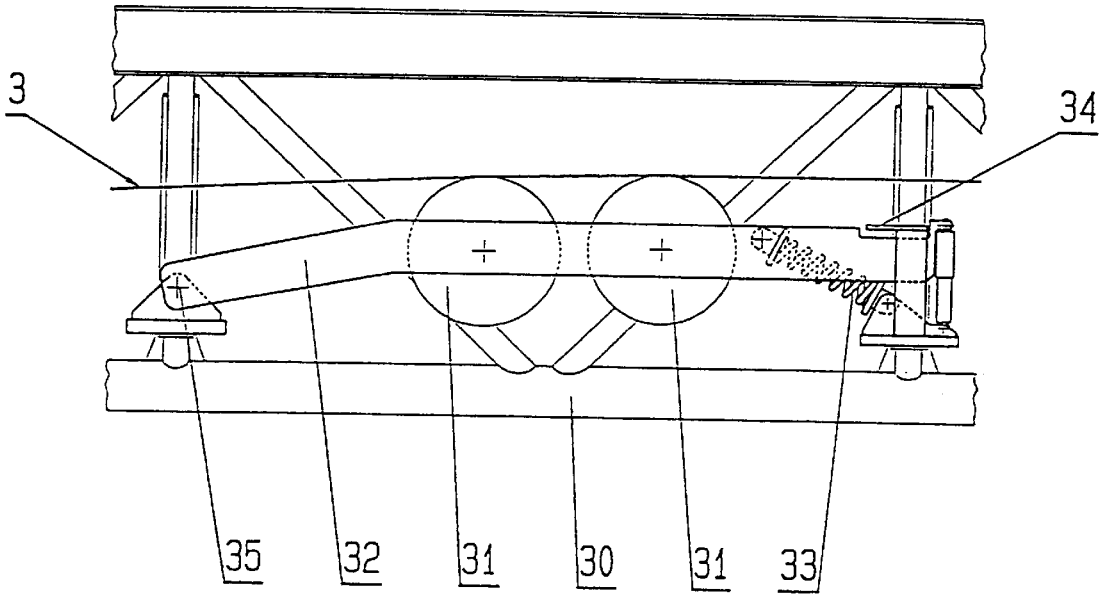
FIG. 4 is an enlarged detail of FIG. 3.

With particular reference to FIGS. 3 and 4, support rollers 31 for the traction cable 3 in the coupling areas, i.e. in the areas at the beginning of the deceleration segment and at the end of the acceleration segment, are also borne on swivel arms 32, wherein these swivel arms 32 can be swung up around axles 35. The axles 35 extend at least approximately horizontally and transversely to the direction of travel, opposite a supporting frame 30 and under the effect of pressure springs 33. Stops 34 define the pivot of the swivel arms 32. The traction cable 3 in these areas is thereby brought into such a position that it is grasped by the clamping assemblies 4 even when vehicles 2 are on a higher level, or, it is held at such a higher level during the disconnection at the start of the deceleration segment that it does not leave the opening clamping assemblies and consequently slide down through its own weight. This prevents excessive wear and tear of the clamping assemblies.

The operation of such a system is as follows: Outside of those areas where passengers board or alight from the vehicles 2, the vehicles are connected to the traction cable 3 by means of the clamping assembly 4. The vehicles are thereby driven along the track at the speed of the traction cable 3, for instance at 8 m/sec. As soon as vehicles 2 enter the area of a boarding/alighting station, the cam roller 41 of the clamping assembly 4 runs onto the cam rails. This causes the clamping assembly 4 to open in opposition to the force of the adjustment spring 42. The vehicle 2 is thereby disconnected from the traction cable 3.

The deceleration wheels then take effect on the contact surface 6, whereby the speed of vehicle 2 is reduced and, if necessary, brought to a complete standstill, such that the passengers can board or alight from the vehicle cabin 21. The vehicle 2 is subsequently accelerated back to the speed of traction cable 3 by means of the acceleration wheels, whereupon it is connected to traction cable 3 by means of clamping assembly 4. The vehicle is then driven by the traction cable 3 into the next boarding and/or alighting station.

In the locations where the vehicles 2 are disconnected from the traction cable 3, there is a risk, if the vehicles 2 are at a higher level, that the traction cable 3 is pulled downwardly and out of the coupling clamps as the coupling clamps are in the process of opening. The coupling clamps are thereby subject to severe wear and tear. In the locations where the vehicles 2 are reconnected to the traction cable 3, there is the risk, if vehicles 2 are at a higher level, that the traction cable 3 is not safely grasped by the coupling clamps.

These problems are overcome with the invention: The support rollers 31 for the traction cable 3 are borne on the swivel arms 32, as shown in FIGS. 3 and 4, at the problematic locations where the vehicles 2 are connected to and disconnected from the traction cable 3. The swivel arms 32 are held under the effect of the pressure springs 33 at such a swing level that the traction cable 3 is held at such a height that it does not slide out of the coupling clamps during disconnection and/or is securely grasped by the coupling clamps during the connection. This ensures the required operational safety and protects the coupling clamps from excessive wear and tear.

I claim:

1. A transportation system, comprising:

a plurality of vehicles equipped with running wheels and a contact surface disposed on an underside thereof, a continuously moving, endless traction cable by which said vehicles are driven along a track, and a clamping assembly for selectively disconnecting said vehicles from and connecting said vehicles to said traction cable;

a boarding station in which said vehicle is disconnectable from said traction cable, and a plurality of deceleration wheels and acceleration wheels disposed along said track in said boarding station, said deceleration wheels and acceleration wheels rotating about substantially horizontal axes and decelerating and accelerating said vehicle, respectively, upon being brought into frictional contact with said contact surface on the underside of said vehicle; and swivel arms each having a free end on which said deceleration wheels and said acceleration wheels, respectively, are rotatably supported, said swivel arms being pivotally supported about an axis which extends substantially horizontally and substantially parallel to said track, and an adjustment spring bearing on each of said swivel arms for pressing said deceleration wheels and said acceleration wheels against said contact surface on the underside of said vehicle.

2. The system according to claim 1, wherein said track is formed by rails upon which said vehicles are supported.

3. The system according to claim 1, which further comprises a U-shaped console having two legs and an upper segment connecting said legs, said swivel arms being each borne in said U-shaped console, said adjusting spring being disposed between said legs, and said upper segment forming a stop against a swinging of said swivel arms.

4. The system according to claim 1, which further comprises a drive wheel rotatably supported on one of said swivel arms carrying said deceleration wheels, said drive wheel being coupled in traction with said deceleration wheels.

5. The system according to claim 1, which further comprises a drive wheel rotatably supported on one of said swivel arms carrying said acceleration wheels, said drive wheel being coupled in traction with said acceleration wheels.

6. The system according to claim 1, which further comprises support rollers supporting said traction cable in said boarding station, further swivel arms supporting said support rollers, said further swivel arms being pivotally disposed about an axis extending substantially horizontally and transversely to said track, and adjustment springs bearing on said further swivel arms for biasing said further swivel arms upwardly.

7. The system according to claim 6, which comprises a support frame carrying said further swivel arms, said support frame being formed with stops against which said further swivel arms are forced by said adjustment springs.

* * * * *